US006063013A

United States Patent [19]

Vathappallil

[11] Patent Number: 6,063,013

[45] Date of Patent: May 16, 2000

[54] RESISTIVE ANKLE EXERCISE DEVICE

[76] Inventor: Sonichan Vathappallil, 41-21 54th St., apt. D, Woodside, N.Y. 11377

[21] Appl. No.: 09/135,444

[22] Filed: Aug. 17, 1998

[51] Int. Cl.[7] ..... A63B 21/02

[52] U.S. Cl. ..... 482/121; 482/79; 482/120; 482/123

[58] Field of Search ..... 482/79, 120, 121, 482/122–124

[56] References Cited

U.S. PATENT DOCUMENTS

| | | | |
|---|---|---|---|
| 5,186,698 | 2/1993 | Mason et al. | 482/79 |
| 5,221,242 | 6/1993 | Weber et al. | 482/79 |
| 5,782,727 | 7/1998 | Pierce | 482/129 |

FOREIGN PATENT DOCUMENTS

| | | | |
|---|---|---|---|
| DAS1091704 | 10/1960 | Germany | 482/79 |

*Primary Examiner*—Richard J. Apley
*Assistant Examiner*—Lori Baker
*Attorney, Agent, or Firm*—Michael I. Kroll

[57] ABSTRACT

The present invention discloses an enclosure 10 having a base with rubber edges 16 to prevent slippage on the floor. A boot 12 for a human foot is provided also. Straps 18 connect boots 12 holding the human feet which straps connect to each other through cables 20 traveling over a pulley means 22 connecting to a multiple spring assembly 40 which cause the straps to be tensioned and to communicate with each other. The multiple springs 40 allow the tension to be adjusted on the straps 18 so that the tension on the boots 12 can be varied, thereby varying the exercise tension on the foot 52. The boots 12 are provided with cleats 50 and hook material 48 for holding the straps 18 thereon.

7 Claims, 10 Drawing Sheets

RESISTIVE ANKLE EXERCISE DEVICE

BACKGROUND OF THE INVENTION

1. Field of the Invention

The present invention relates generally to an exercise device and, more specifically, to an exercise device which can be used to target and strengthen the ankles by providing spring resistance to the movement of the ankle muscles.

2. Description of the Prior Art

There are numerous exercise devices designed to strengthen the ankle and lower limb. Typical of these exercise devices is U.S. Pat. No. 5,100,129 issued to Porter et al on Mar. 31, 1992.

Another exercise device patent was issued to Mason et al on Feb. 16, 1993 as U.S. Pat. No. 5,186,698. Yet another U.S. Pat. No. 5,368,536 was issued to Stodgell on Nov. 29, 1994. Yet still another U.S. Pat. No. 4,998,722 was issued to Scott on Mar. 12, 1991 and another was issued to Togao on Jul. 15, 1997 as U.S. Pat. No. 5,647,830.

U.S. Pat. No. 5,100,129

Inventor: Porter et al

Issued: Mar. 5, 1991

A home self-exercising device for strengthening the muscles, tendons and ligaments of the foot, ankle, and lower leg, especially the forward lower leg muscles. The foot harness is adjusted to grasp the heel and forward foot of the patient. An elastic tension member is secured to the harness in the vicinity of the ball of the foot, and the other end is secured to an article of future or the like. The foot may then be moved against the force of the elastic member in the upward direction and rotated about the ankle. The difficulty of exercising the front lower leg muscle without the aid of another person is overcome by this device.

U.S. Pat. No. 5,186,698

Inventor: Bradley R. Mason

Issued: Feb. 16, 1993

A system utilizable by a patient engaged in strengthening, stretching or range of motion exercise therapy of the ankle which contains a number of interactive components combinable in any one of several different configurations to provide the patient with specific ankle exercise devices. One such device provides ankle dorsiflexion and inversion/eversion strengthening exercises performed by moving the patient's foot in various directions against the elastic resistance of an elastomeric tube while the device provides ankle dorsiflexion, plantarflexion and inversion/eversion strengthening by exerting the foot against resistance from the patient across a strap. Yet another device provides ankle supination/pronation, toe flexion/extension, and isometric eversion exercises by performing various movements with the toes or feet to deform a towel. The final device is for stretching and ankle range of motion exercises by placing the patient's foot on a platform and rocking the platform on curved runners in various directions.

U.S. Pat. No. 5,368,536

Inventor: Mark E. Stodgell

Issued: Nov. 29, 1994

An ankle rehabilitation device providing for exercise movement duplicating the complete range of ankle movement including plantar and dorsi flexion, inversion, eversion and rotation. The amount of resistance to movement and the direction of resistance may be changed without disattaching the foot from the device. A tensioning device is also provided to permit use of the device for isometric exercise of the ankle. An ankle rehabilitation device according to one embodiment of the invention comprises a base, a support post mounted to the base, a base plate rotatably mounted to the support post, and a two bar linkage mounted at one end to the base plate and at the other end to one of a plurality of attachment points on the foot receiving platform. A coil-spring is operatively connected between the bars of the linkage.

U.S. Pat. No. 4,998,722

Inventor: Janes W. Scott

Issued: Mar. 12, 1991

An isotonic exercising apparatus for exercising the lower limb of a user. The apparatus provides a fabric sock slipped over the foot of the user. An elongated, elastic strip secures tills sock to a support enabling the user to isotonically exercise his lower limb muscles by tensioning the strip.

U.S. Pat. No. 5,647,830

Inventor: Kasuhiko Tagao

Issued: Jul. 15, 1997

A flat board section 1 with a flat top surface 1*a,* which is formed as a flat surface, is made of a wooden board with sufficient thickness and strength for supporting a human body. A top surface 1*a* of flat board section 1 is octagonal and has an area which enables both feet or buttocks of a person to be placed thereon. A fulcrum section 2, which is made of metal and has a hemispherical protrusion 2*a,* is provided at a central part of a bottom surface 1*b* of flat board section 1. Protrusion 2*a* is the part which always contacts with a floor surface or the ground when flat board section 1 is placed on the floor surface or the ground and is the part which serves as the center of winging of flat board section 1.

The invention presents a health equipment by which the lack of exercise can be resolved in a simple manner at home and regardless of athletic ability.

While these lower limb exercise devices may be suitable for the purposes for which they were designed, they would not be as suitable for the purposes of the present invention, as hereinafter described.

SUMMARY OF THE PRESENT INVENTION

The present invention discloses a foot receiving enclosure having rubber edges on its base to prevent slippage on the floor. A boot for receiving a human foot is provided also. Straps connect the boot holding the human foot to cables traveling over a pulley means connecting to a multiple spring assembly which cause the straps to be tensioned and to communicate with each other. The multiple springs allow the tension to be adjusted on the straps so that the tension on the boots can be varied, thereby varying the exercise tension on the foot. The boots are provided with cleats and hook material for securing the straps thereon.

A primary object of the present invention is to provide a non impact exercise device whereby the user will be able to strengthen the numerous muscles within the lower leg, ankle, and foot by using a progressive amount of resistance provided by a number of springs.

Another object of the present invention is to provide a boot that will provide support for the ankle and foot while exercising.

Additional objects of the present invention will appear as the description proceeds.

The present invention overcomes the shortcomings of the prior art by providing a exercise device which supports the ankle and foot while providing a user selectably resistance using a number of springs.

The foregoing and other objects and advantages will appear from the description to follow. In the description reference is made to the accompanying drawings, which form a part hereof, and in which is shown by way of illustration or specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

Figure 1:
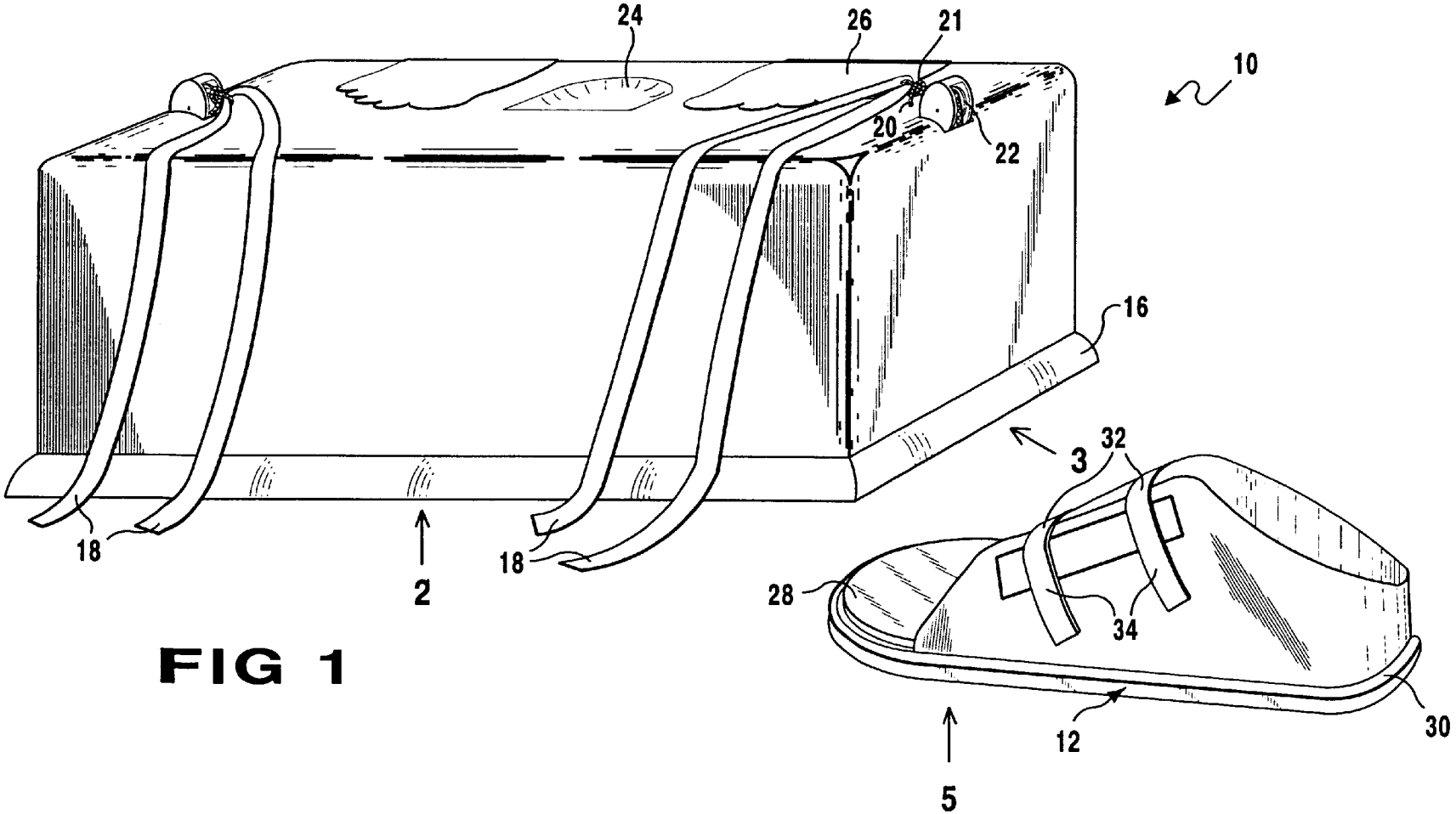
FIG. 1 is a front perspective view of the present invention. Shown are the two members of the exercise device which may be used singularly or in conjunction with each other.

With regard to the reference numerals, the following numbering is used throughout the various drawings.

10 foot receiving enclosure
12 boot
16 base with rubber edges
18 straps
20 cables
21 cable knot
22 pulley means
24 heeling receiving impression
26 foot imprints
28 toe of boot
30 heel of boot
32 boot straps
34 strap ties
38 bar
39 cable connection means
40 springs
41 spring connection means
42 solid center member
43 spring support member
44 channels for springs
46 bottom of boot
48 hook material
50 cleats
52 human foot

DESCRIPTION OF THE PREFERRED EMBODIMENT(S)

FIG. 1 is a perspective view of the present invention showing the two members of the exercise device which may be used singularly or in conjunction with each other. Turning to FIG. 1, therein is shown the foot receiving enclosure generally shown at 10 and the foot receiving boot 12. The enclosure 10 has rubber edging 16 around its base. Furthermore, shown therein on the foot receiving enclosure are the foot straps 18 which are connected to cable 20 having a loop or cable knot 21 therein to serve as a cables stop which cables travel over pulley assemblies 22 into the interior of the enclosure as will be hereinafter described. Also shown on the enclosure are the heel receiving depression 24, along with the foot pads 26 which are used for placement of the feet. Turning to the boot 12, therein is shown the toe 28 of the boot 12 along with the heel 30 and the straps 32 for securing and fitting the boot about the foot having closure or connecting means 34 which may be of velcro or like means such as strap ties.

Figure 2:
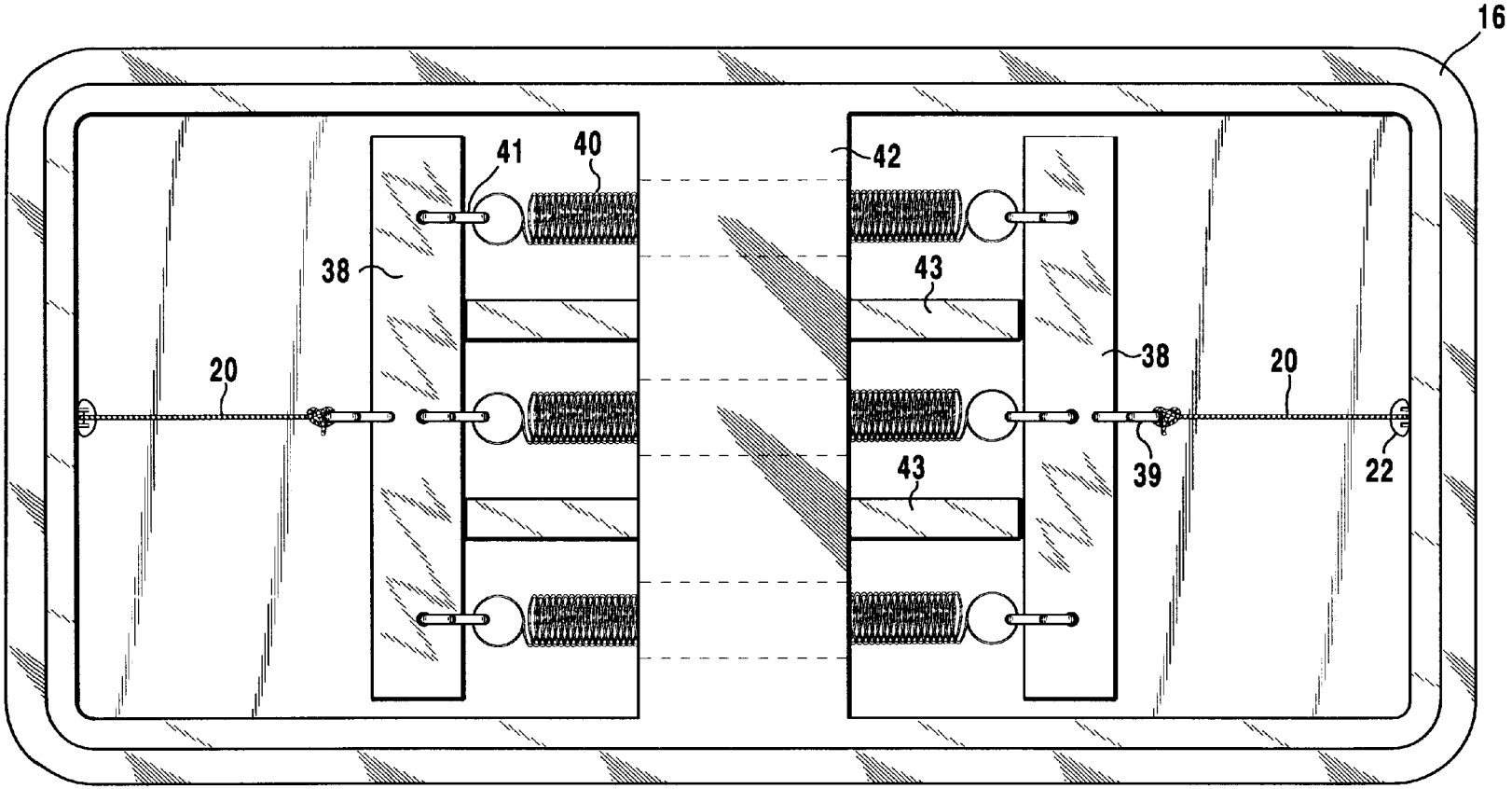
FIG. 2 is a bottom plan view of the present invention. Shown is the wire which is attached to a bar which rests on additional carriage supports as well as allowing the user to select one, two or three springs for varying resistance taken in the direction of the arrow labeled with the numeral 3 of FIG. 1.

Turning to FIG. 2, therein is shown a bottom plan view of the foot receiving enclosure 10 of the present invention showing the rubber edges 16 of the foot receiving enclosure with the cables 20, the pulley assembly 22, the bars 38 which provide a connecting means between the cables and the multiple springs 40, along with spring support members 43 and the solid centerpiece 42 of the enclosure which provides strength to the enclosure. The springs 40 are designed so that the user can use one, two or all three springs in order to adjust the tension or force applied to the users foot. The cables 20 is connected to the bar 38 at a cable connecting means 39. The springs are connected to the bars at spring connection means 41. FIG. 2 makes it clear that the cables 20 communicate with each other through the springs 40 and indicates that the cable knots 21 are necessary to keep the cables 20 and straps 18 from being pulled by the springs 40 into the interior of the foot receiving enclosure 10. In operation it should be clear that the straps 18 are tensioned by the springs 40 and apply pressure to the feet of the user if either strap is pulled or tensioned by the user.

Figure 3:
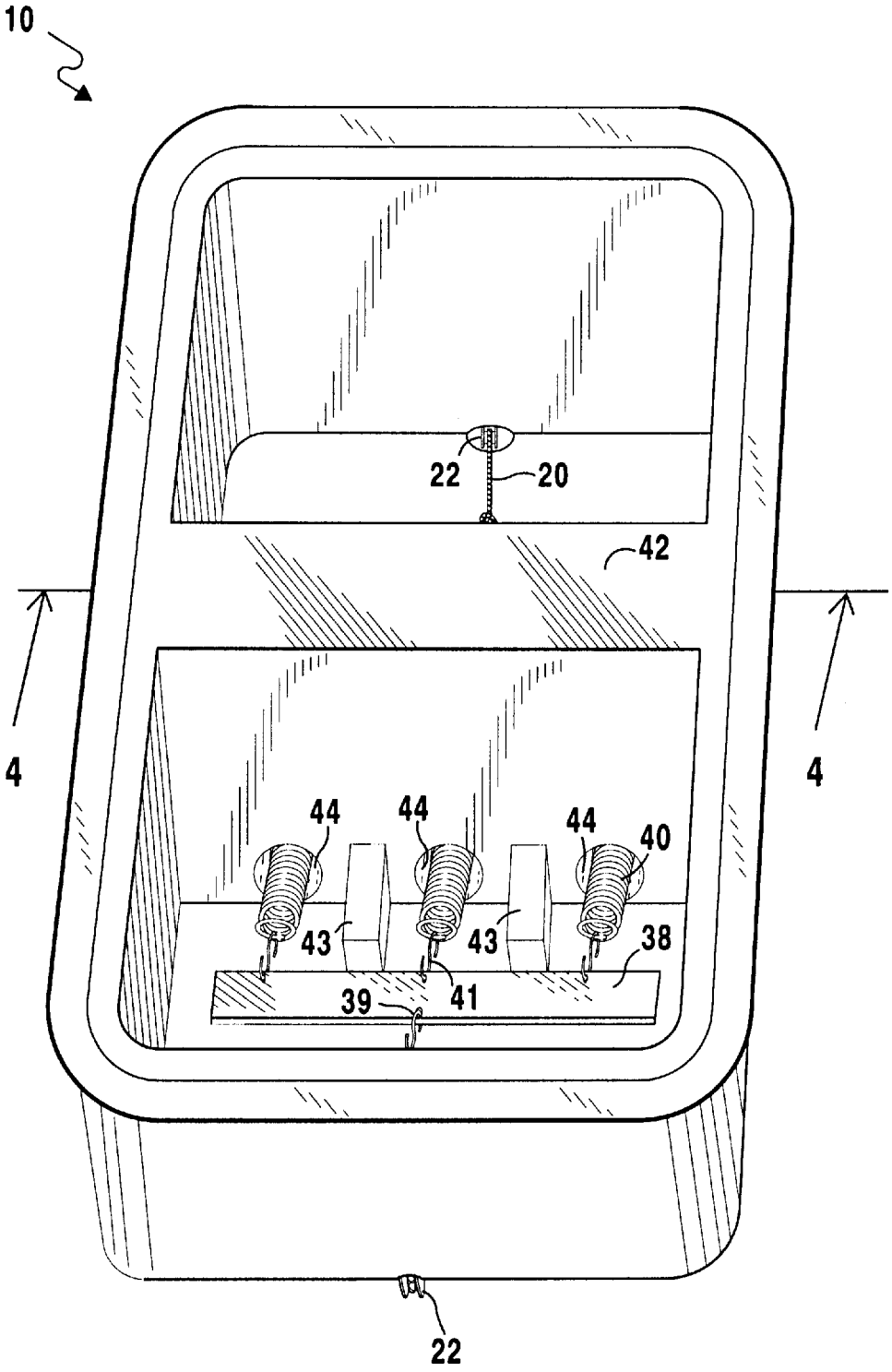
FIG. 3 is a bottom perspective view taken in the direction of the arrow labeled with the numeral 3 of FIG. 1 of the present invention showing the channel which the springs pass through to the bar located on the other side. Also shown are the additional support members.

Turning to FIG. 3, therein is shown a bottom perspective view of the present invention showing the foot receiving enclosure 10, the pulley means 22, the cables 20, the cable connection means 39, the bar 38, the springs 40, the spring connection means 41, and the solid center member 42. Also shown is the spring support members 43 and the channels 44 through which the springs 40 pass.

Figure 4:
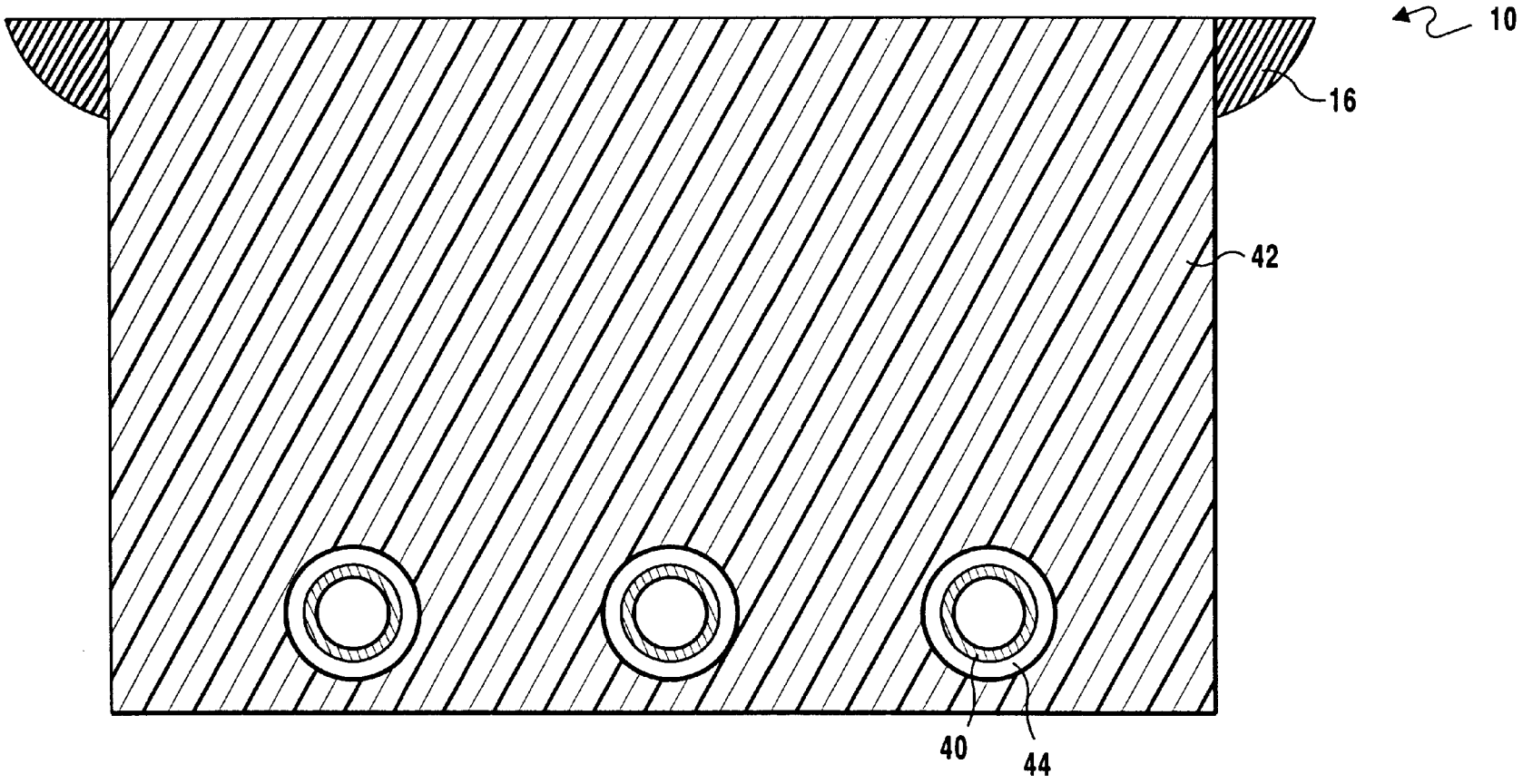
FIG. 4 is a cross sectional taken from FIG. 3 as indicated showing the solid center member. Also shown are the rubber edging which act to prevent the device from sliding while in use. Also shown are the spring channel and the springs.

Turning to FIG. 4, which is a cross-sectional view taken from FIG. 3, shown therein is the foot receiving enclosure 10 with rubber edges 16, the solid centerpiece 42, the channels for the springs 44, and the springs 40.

Figure 5:
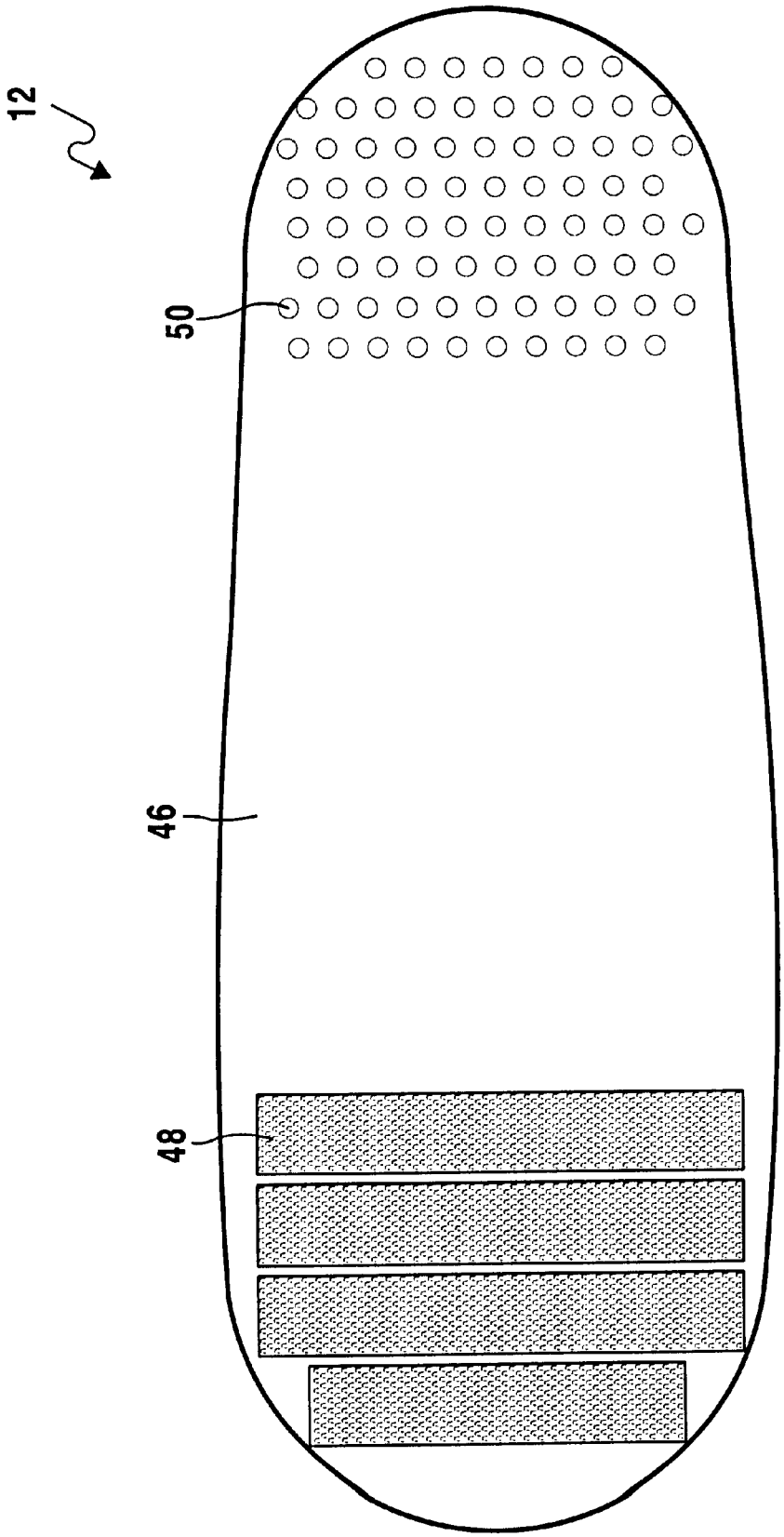
FIG. 5 is a bottom plan of the boot taken in the direction of the arrow labeled with the numeral 5 of FIG. 1 which has a number of strips of hook material to mate with the loop material located on the device straps. Also shown are a number of rubber cleats to provide the boot with traction.

Turning to FIG. 5 therein is shown a bottom 46 plan view of the boot 12 which has a number of strips of hook material 48 to mate with the loop material located on the device straps 18. Also shown are the cleats 50 of the boot for providing traction. The hook material 48 assures that the straps 18 will be securely connected to the boot 12.

Figure 6:
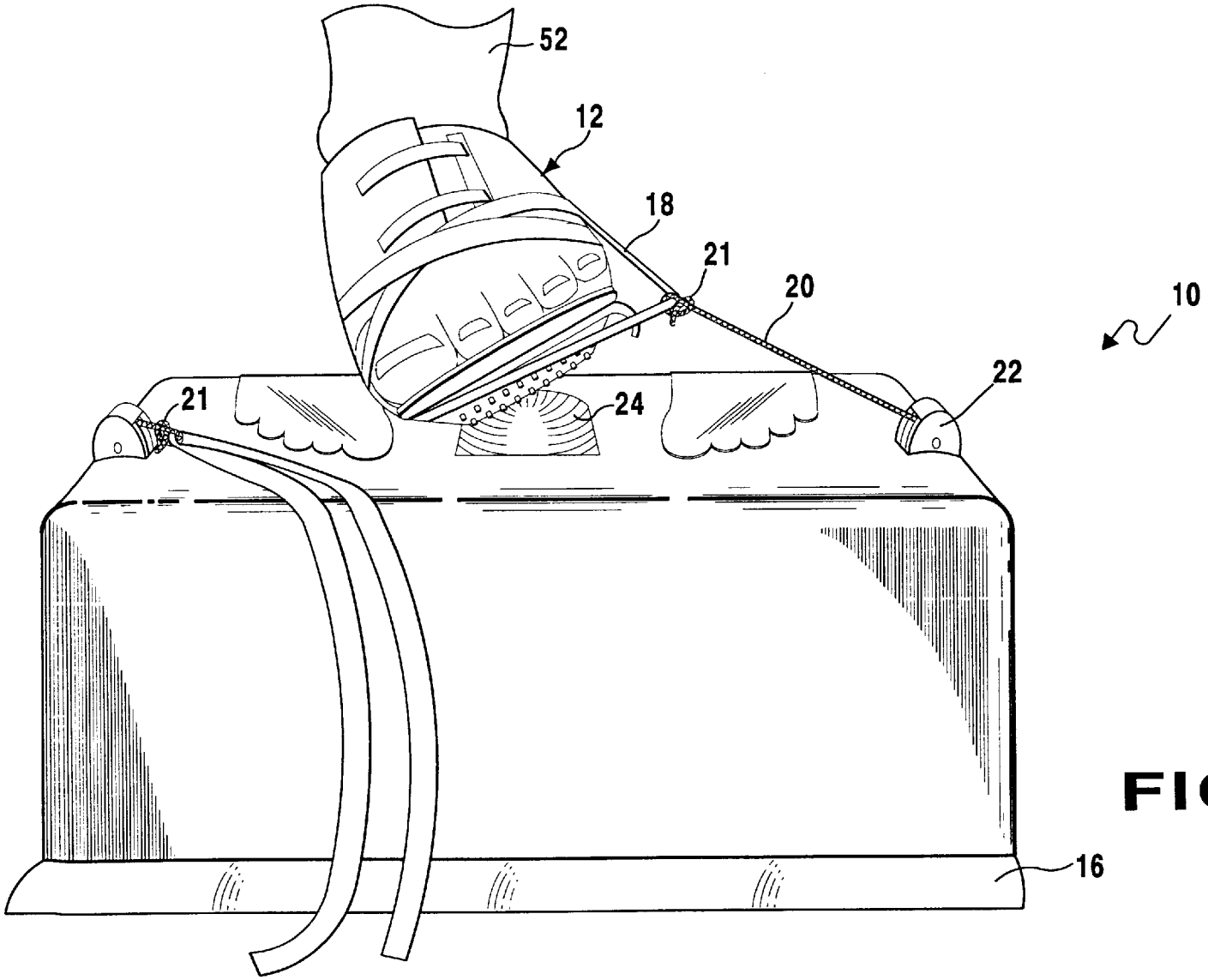
FIG. 6 is an example of the use of the invention wherein the left foot is placed in the boot and the boot is placed in the heel depression and the straps are wrapped around the boot. The individual would select the number of springs and move the foot away from the springs.

Turning to FIG. 6 therein is shown the left foot of a human 52 in operative connection with the foot receiving enclosure present invention generally shown at 10. Also shown therein is the boot 12, the foot receiving enclosure 10 with rubber edges 16, the straps 18, the cables 20, the pulleys 22, and also the heel receiving impression 24. Here the loop material of the straps 18 is attached to the hook material 48 of the boot. Shown in FIG. 6 is the left foot being rotated inwardly in order to strengthen the muscles of the lower ankle leg. Note that the cable knots 21 prevent the end of the cable which is not being used, i.e., attached to the users foot, from being pulled into the interior of the enclosure 10. In operation, the user places his foot 52 on the foot receiving enclosure 10 with the heel in the heel receiving impression 24 and after attaching the strap 18 to the foot 52 exercises the foot against the tension of the cables 20 which is applied by the springs 40.

Figure 7:
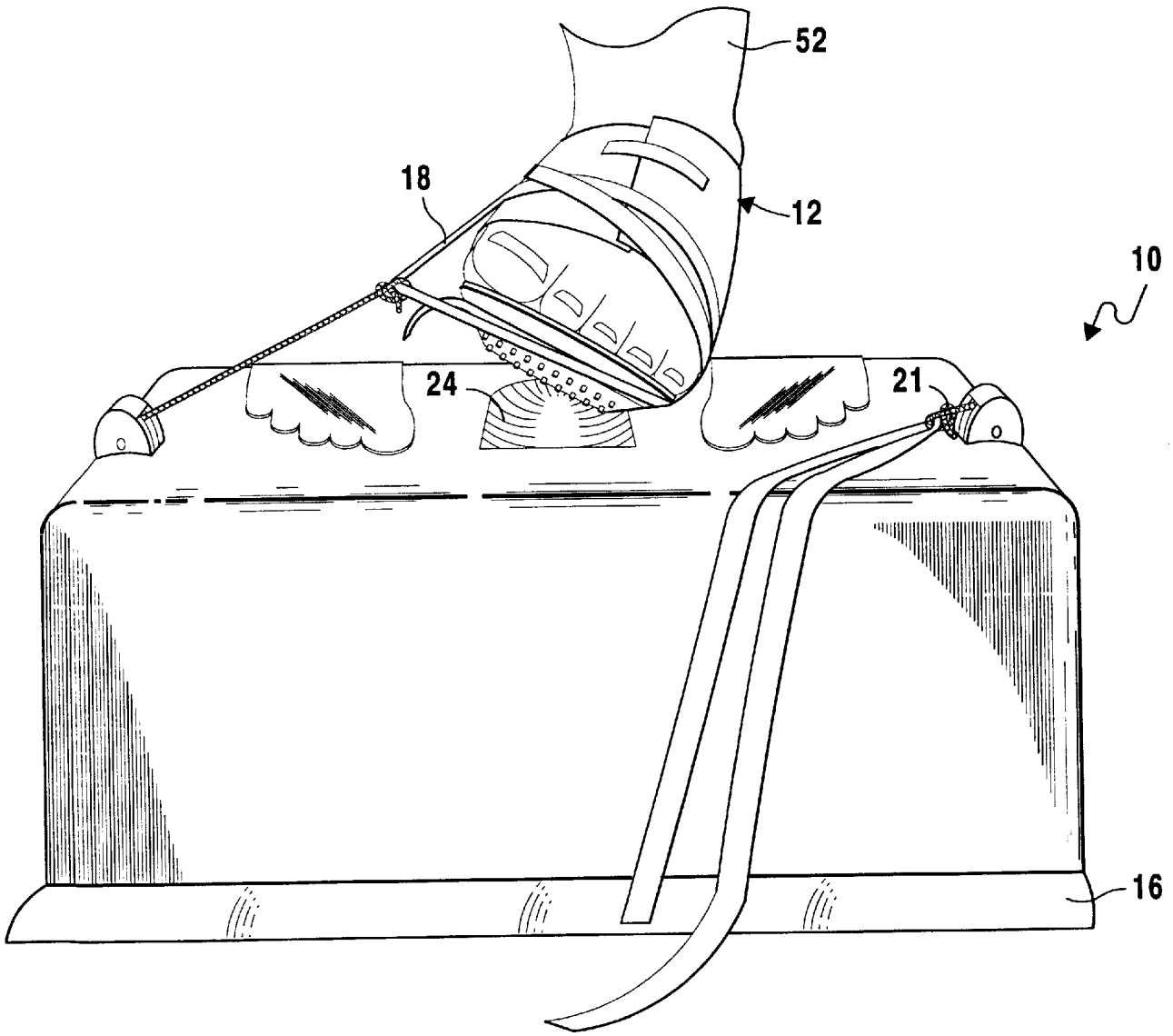
FIG. 7 is an example of the use of the invention wherein the left foot is placed in the boot and the boot is placed in the heel depression and the straps are wrapped around the boot. The individual would select the number of springs and move the foot away from the springs.

Turning to FIG. 7, shown therein is the left foot 52 of a human placed in operative connection with the foot receiving enclosure present invention generally shown at 10 similarly to FIG. 6. Therein is shown the left foot of a human 52 in operative connection with the foot receiving enclosure of the present invention generally shown at 10. Also shown therein is the boot 12, the base with rubber edges 16, the straps 18 secured to the boot, the cables 20, the cable knots 21, the pulleys 22, and also the heel receiving impression 24. Shown in FIG. 7 is the left foot being rotated outwardly in order to strengthen the muscles of the lower leg and ankle.

Figure 8:
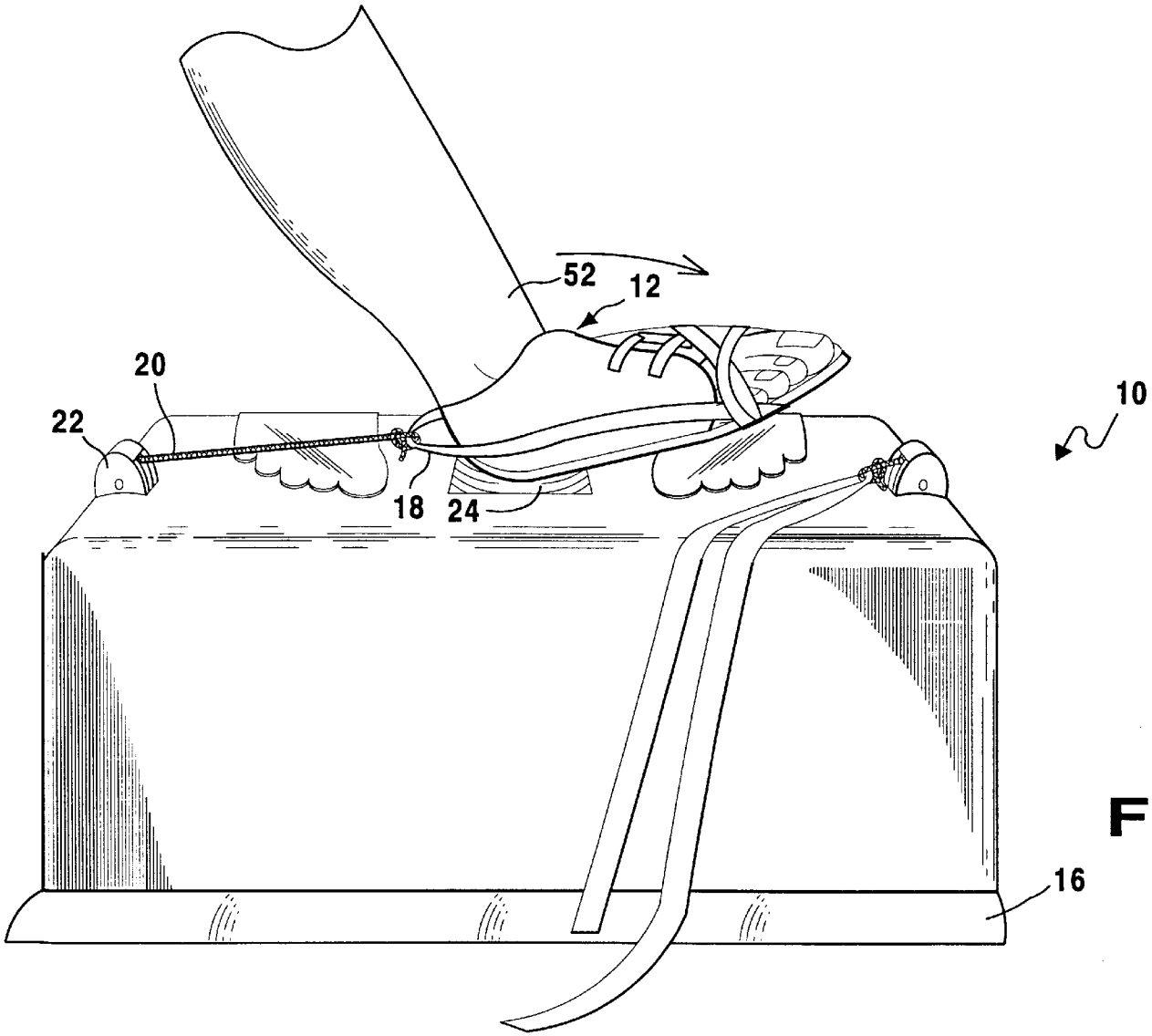
FIG. 8 is another example of the use of the invention wherein the boot is placed in the heel depression and the straps from the far end of the device are wrapped around the boot. The individual would select the number of springs and moving the foot from a lowered position to a raised position.

Turning to FIG. 8 therein is shown another example of the use of the invention wherein the boot 12 is placed in the heel receiving impression 24 and the straps 18 from the opposite end of the device are wrapped around and secured to the boot 12. The individual user would next select the number of springs to be used for tensioning and then begins exercising the foot by moving the foot from a lowered position to a raised position. Turning to FIG. 8, shown therein is the right foot of a human 52 shown in operative connection with the foot receiving enclosure of the present invention generally shown at 10. Also shown therein is the base with rubber edges 16, the straps 18, the cables 20, and the pulleys 22, and also the heel receiving impression 24.

Figure 9:
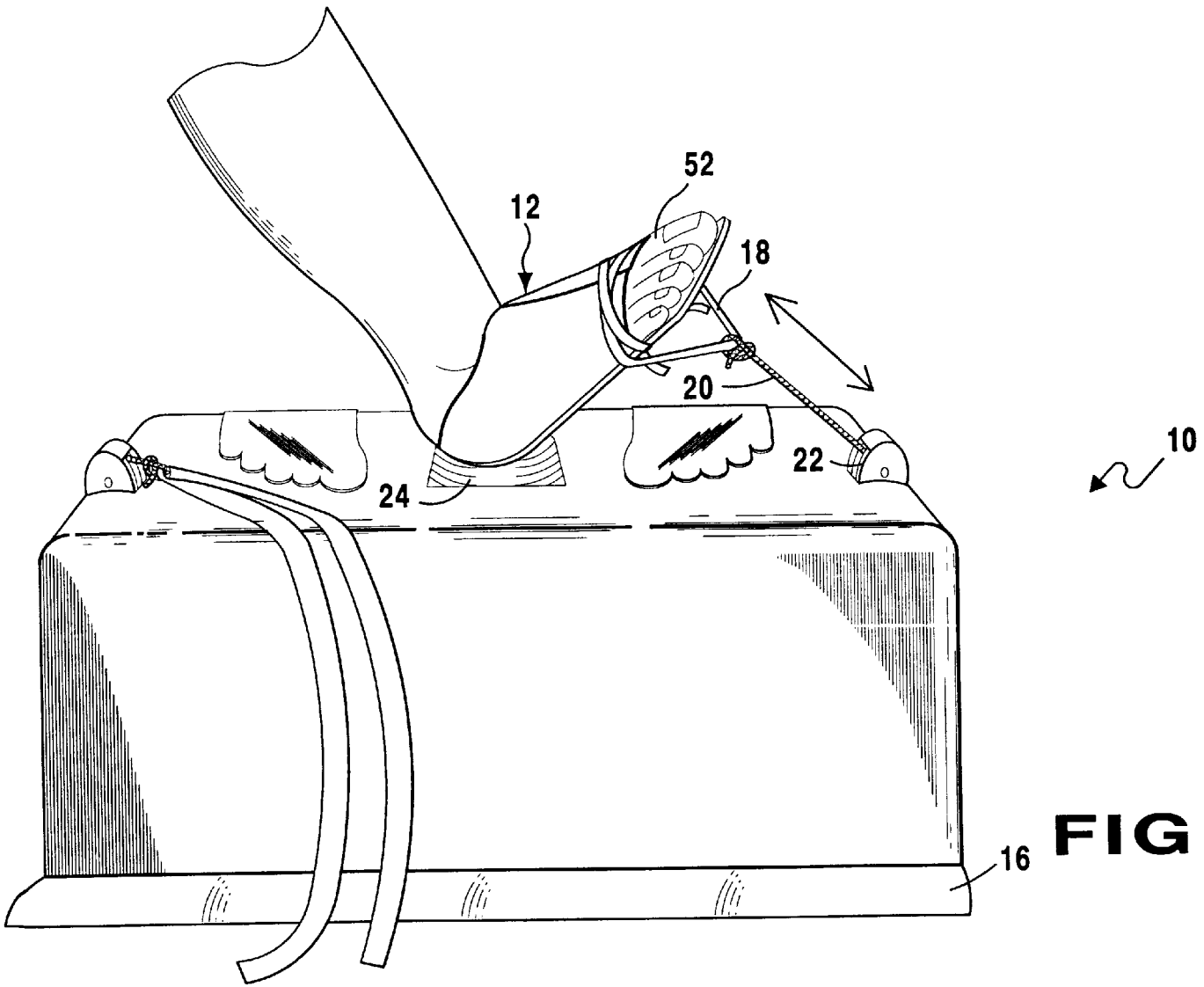
FIG. 9 is another example of the use of the invention wherein the boot is placed in the heel depression and the straps are wrapped around the boot. The individual would select the number of springs and move the foot from a lowered position to a raised position.

Turning to FIG. 9, shown therein is an alternative exercise position for using the present invention showing the right foot of a human 52 placed in the heel receiving impression 24, shown in operative connection with the foot receiving enclosure of the present invention generally shown at 10. Also shown therein is the boot 12, the base with rubber edges 16, the straps 18, the cables 20, the pulleys 22, and also the heel receiving impression 24.

Figure 10:
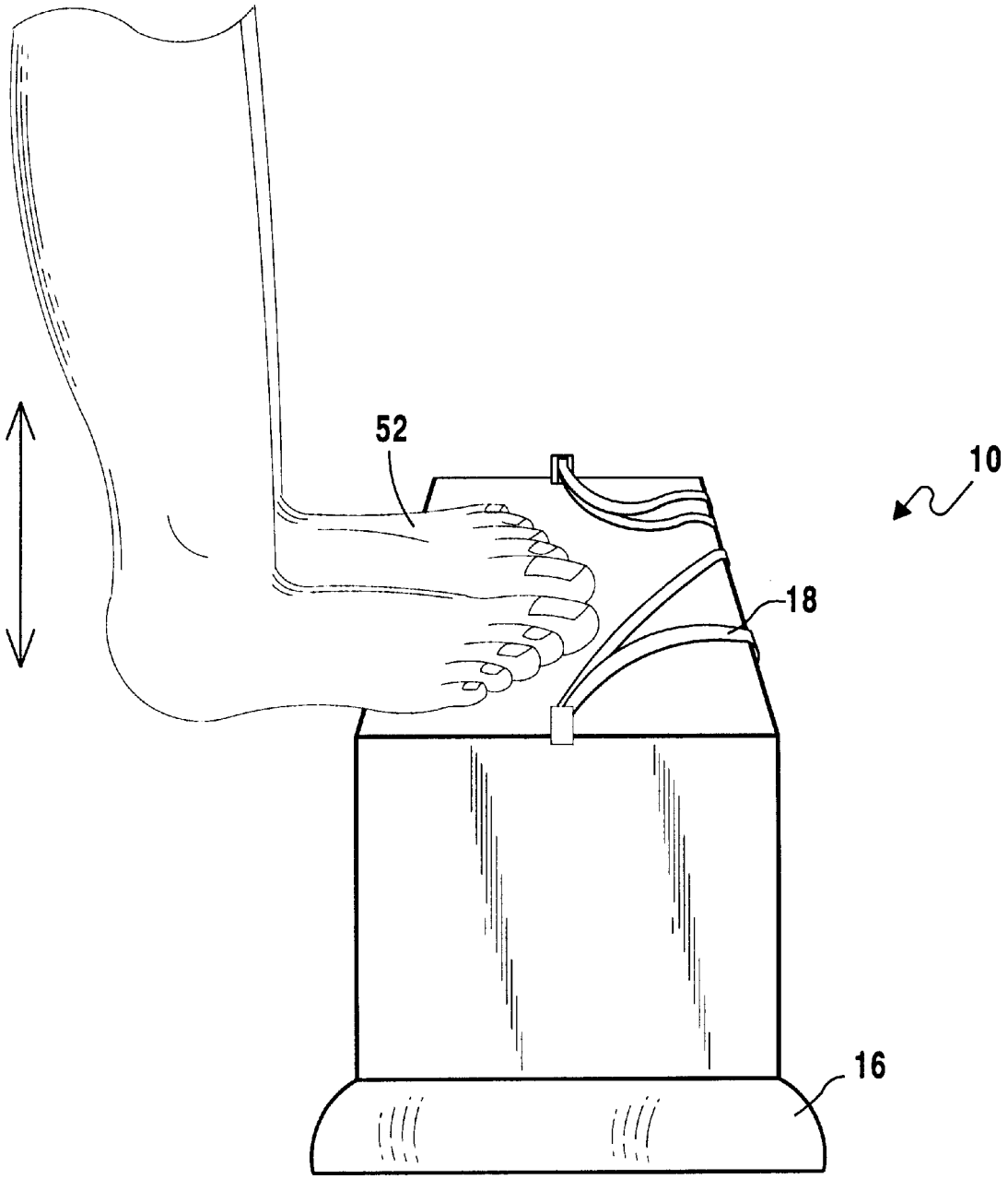
FIG. 10 is another example of the use of the invention where the individual stands with the front of the foot on the rubber pad located on the upper surface of the device and the heel extended away from the device and raises the body from the ball of the foot and returning to the starting position.

Turning to FIG. 10 is another example of the use of the invention where the individual stands with the front of his feet 52 on the rubber pads 26 (not shown) located on the upper surface of the foot receiving enclosure 10 with his heels extended away from the device and then the user exercises by raising his body until he is standing on the ball of the feet and then returns to the starting position. Therein is shown both feet of a human 52 shown in operative connection with the foot receiving enclosure of the present invention generally shown at 10 wherein the human is standing on the foot receiving enclosure of the present invention 10. Also shown therein is the base with rubber edges 16 and the straps 18. In this position the user can exercise his ankles and legs by raising and lowering himself on the balls of his feet.

I claim:

1. An apparatus for exercising feet comprising:

a) a foot receiving enclosure sized for use by humans and having rubber edges on its bottom for gripping the floor;

b) a boot for insertion of a human foot;

c) straps for connection to said boot, said straps communicating with each other through the interior of said enclosure; and d) tensioning means for said straps located in the interior of said enclosure whereby said straps communicate with each other and apply force for exercising a human foot, wherein said straps are connected to said tensioning means by cable means.

2. The apparatus of claim 1, wherein said tensioning means further comprise spring means.

3. The apparatus of claim 1, further comprising said boot having cleats on its soles.

4. An apparatus for exercising feet comprising:

a) a foot receiving enclosure sized for use by humans and having rubber edges on its bottom for gripping the floor;

b) a boot for insertion of a human foot;

c) straps for connection to said boots said straps communicating with each other through the interior of said enclosure; and d) tensioning means for said straps located in the interior of said enclosure whereby said straps communicate with each other and apply force for exercising a human foot, wherein said boot has hook material on its sole.

5. An apparatus for exercising feet comprising:

a) a foot receiving enclosure sized for use by humans and having rubber edges on its bottom for gripping the floor;

b) a boot for insertion of a human foot;

c) straps for connection to said boot, said straps communicating with each other through the interior of said enclosure; and d) tensioning means for said straps located in the interior of said enclosure whereby said straps communicate with each other and apply force for exercising a human foot, wherein said straps have loop material whereby said straps are attached to said boots.

6. The apparatus of claim 1, further comprising said enclosure having a heel depression on its upper surface for insertion of the heel of the user.

7. The apparatus of claim 1, further comprising said tensioning means being adjustable whereby said tension on said straps is variable.

* * * * *